US012466604B2

(12) United States Patent
Carpenter et al.

(10) Patent No.: US 12,466,604 B2
(45) **Date of Patent: *Nov. 11, 2025**

(54) CONTAINER WITH REMOVABLE END

(71) Applicant: SONOCO DEVELOPMENT, INC., Hartsville, SC (US)

(72) Inventors: Lawrence Robert Carpenter, Darlington, SC (US); Tony L. Thomas, Hartsville, SC (US); Paul E. Miller, Cheraw, SC (US); Kurt A. Ziegenfelder, Florence, SC (US)

(73) Assignee: SONOCO DEVELOPMENT, INC., Hartsville, SC (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/398,800

(22) Filed: Dec. 28, 2023

(65) Prior Publication Data

US 2024/0124186 A1 Apr. 18, 2024

Related U.S. Application Data

(63) Continuation of application No. 16/922,468, filed on Jul. 7, 2020, now Pat. No. 11,999,530.
(Continued)

(51) Int. Cl.

| | |
|---|---|
| ***B65D 3/04*** | (2006.01) |
| ***B65D 3/26*** | (2006.01) |
| ***B65D 3/28*** | (2006.01) |

(52) U.S. Cl.
CPC ..... *B65D 3/04* (2013.01); *B65D 3/262* (2013.01); *B65D 3/28* (2013.01)

(58) Field of Classification Search
CPC . B65D 3/262; B65D 3/04; B65D 3/28; B65D 51/20; B65D 2251/0093; B65D 3/266; B65D 43/02; Y02W 30/80; Y02W 90/10; B32B 1/08; B32B 2255/12; B32B 2307/748
USPC ..... 229/107, 4.5, 202, 5.5, 201, 164.2, 245, 229/93; 206/830; 428/34.2, 36.91; 156/190, 184; 426/128; 220/359.3, 220/495.03, 620
See application file for complete search history.

(56) References Cited

U.S. PATENT DOCUMENTS

| | | | |
|---|---|---|---|
| 3,580,468 | A | 5/1971 | McDevitt |
| 3,682,355 | A | 8/1972 | Lo |

(Continued)

FOREIGN PATENT DOCUMENTS

| | | | |
|---|---|---|---|
| DE | 29809015 | U1 | 9/1998 |
| EP | 1002731 | A1 | 5/2000 |
| EP | 1149771 | A2 | 10/2001 |

OTHER PUBLICATIONS

International Search Report and Written Opinion for International application No. PCT/US/2020/041004; Dated Aug. 13, 2020; 10 pages.

*Primary Examiner* — Christopher R Demeree
(74) *Attorney, Agent, or Firm* — Nelson Mullins Riley & Scarborough LLP

(57) ABSTRACT

The invention comprises a container comprising: a base; at least one paper-based sidewall seamed to and extending upwardly from the base, wherein the at least one sidewall comprises a score line near the base that is at least partially circumferential and is configured to be torn through to remove the base from the sidewall; and a liner ply adhered to an interior surface of the sidewall.

17 Claims, 10 Drawing Sheets

Related U.S. Application Data

(60) Provisional application No. 62/871,420, filed on Jul. 8, 2019.

(56) References Cited

U.S. PATENT DOCUMENTS

| | | | | |
|---|---|---|---|---|
| 4,295,840 | A | 10/1981 | Sansbury | |
| 5,494,215 | A | 2/1996 | Drummond et al. | |
| 5,584,409 | A | 12/1996 | Chemberlen | |
| 5,988,493 | A | 11/1999 | Clougherty | |
| 6,036,629 | A | 3/2000 | Rea et al. | |
| 6,152,355 | A | 11/2000 | Morrow et al. | |
| 6,230,968 | B1 | 5/2001 | Varadarajan | |
| 6,422,455 | B1 * | 7/2002 | Cahill | B31C 3/04 206/524.8 |
| 6,460,759 | B1 | 10/2002 | Lowry et al. | |
| 6,510,674 | B1 | 1/2003 | Case | |
| 6,604,307 | B1 | 8/2003 | Cahill et al. | |
| 6,733,803 | B1 | 5/2004 | Vidkjaer | |
| 7,131,550 | B2 | 11/2006 | Montserrat et al. | |
| 7,828,197 | B2 | 11/2010 | Schuetz | |
| 8,434,637 | B2 | 5/2013 | Kozo et al. | |
| 9,573,747 | B2 | 2/2017 | Koland et al. | |
| 10,081,475 | B2 | 9/2018 | Buisson et al. | |
| 10,526,105 | B2 | 1/2020 | Guertin | |
| 2003/0178429 | A1 | 9/2003 | Williams et al. | |
| 2004/0185205 | A1 * | 9/2004 | van de Camp | B31C 3/00 156/190 |
| 2007/0295795 | A1 * | 12/2007 | Clougherty | B65D 3/266 229/4.5 |
| 2009/0212071 | A1 | 8/2009 | Tom et al. | |
| 2013/0161349 | A1 | 6/2013 | Pfeiffenberger | |
| 2020/0087049 | A1 * | 3/2020 | Miller | B65D 25/14 |
| 2021/0371140 | A1 * | 12/2021 | Price | B65B 7/2807 |

* cited by examiner

CONTAINER WITH REMOVABLE END

CROSS-REFERENCE TO RELATED APPLICATIONS

This application is a continuation of U.S. Non-Provisional application Ser. No. 16/922,468, filed Jul. 7, 2020, entitled "Container with Removable End", which claims priority to U.S. Provisional Patent Application No. 62/871,420, filed Jul. 8, 2019, entitled "Container with Removable End", which is incorporated herein in its entirety.

FIELD OF THE INVENTION

The present invention relates generally to containers with removable ends and methods for making such containers.

BACKGROUND OF THE INVENTION

Composite containers are used for packaging a wide variety of food and drink products as well as non-food items. These containers are constructed to be opened at one of two spaced ends that are initially sealed. Typically, the container body comprises at least one ply of a paperboard material which may be formed into a tubular structure. These containers often include at least one removable end closure and one permanently sealed metal or plastic end closure, typically at the bottom end. Once opened via the removable end closure and the product contained therein is consumed or used, the consumer may choose to recycle the paperboard container. However, due to the presence of the permanently adhered metal or plastic end, recyclability is limited or is costly in many jurisdictions, as the metal or plastic must be manually separated from the paperboard container in order to recycle each component separately.

SUMMARY OF THE INVENTION

According to an aspect, the present invention provides a container which has a removable end, wherein the removable end is defined by score lines about the perimeter of the container sidewall in a location near the removable end. The inventive container may provide advantages in recyclability of the end product, as the paperboard container can be easily separated by the consumer from the metal or plastic end closure as well as, optionally, any liner layer that is disposed within the container body.

In an embodiment, the invention comprises a container comprising: a base; at least one paper-based sidewall seamed to and extending upwardly from the base, wherein the at least one sidewall comprises a score line near the base that is at least partially circumferential and is configured to be torn through to remove the base from the sidewall; and a liner ply adhered to an interior surface of the sidewall.

In certain embodiments, the container sidewall comprises a composite material. In certain embodiments, the container is rigid. In certain embodiments, the container comprises spiral-wound paperboard. In certain embodiments, the liner ply comprises a polymeric material. In certain embodiments, the liner ply comprises barrier properties. In certain embodiments, the adhesive comprises a dextrin-based adhesive. In certain embodiments, the adhesive is flood coated between the liner ply and the sidewall. In an embodiment, the base comprises metal. In an embodiment, the score line comprises a fully circumferential perforation. In an embodiment, the score line comprises a continuous cut line, is fully circumferential, and does not penetrate the entire thickness of the sidewall. In an embodiment, the score line extends substantially through the thickness of the sidewall. In an embodiment, an uncut portion of the sidewall in the location of the score line comprises a sidewall thickness of between about 0.001 and 0.005 inches. In an embodiment, an uncut portion of the sidewall in the location of the score line comprises a sidewall thickness of between about 0.002 and 0.003 inches. In an embodiment, the distance between the score line and the base is between about 0.100 inches and about 0.400 inches. In an embodiment, the distance between the score line and the base is between about 0.180 inches and about 0.250 inches. In an embodiment, the invention comprises a second score line near a top end of the sidewall, wherein the second score line is at least partially circumferential. In an embodiment, the liner ply is configured to be torn through in the location of the score line. In an embodiment, the adhesive comprises a polyvinyl acetate-based adhesive. In an embodiment, the adhesive comprises a dextrin-based adhesive.

The accompanying drawings, which are incorporated in and constitute a part of this specification, illustrate one or more embodiments of the invention and, together with the description, serve to explain the principles of the invention.

BRIEF DESCRIPTION OF THE DRAWINGS

A full and enabling disclosure of the present invention, including the best mode thereof directed to one of ordinary skill in the art, is set forth in the specification, which makes reference to the appended drawings, in which.

and

Figure 1:
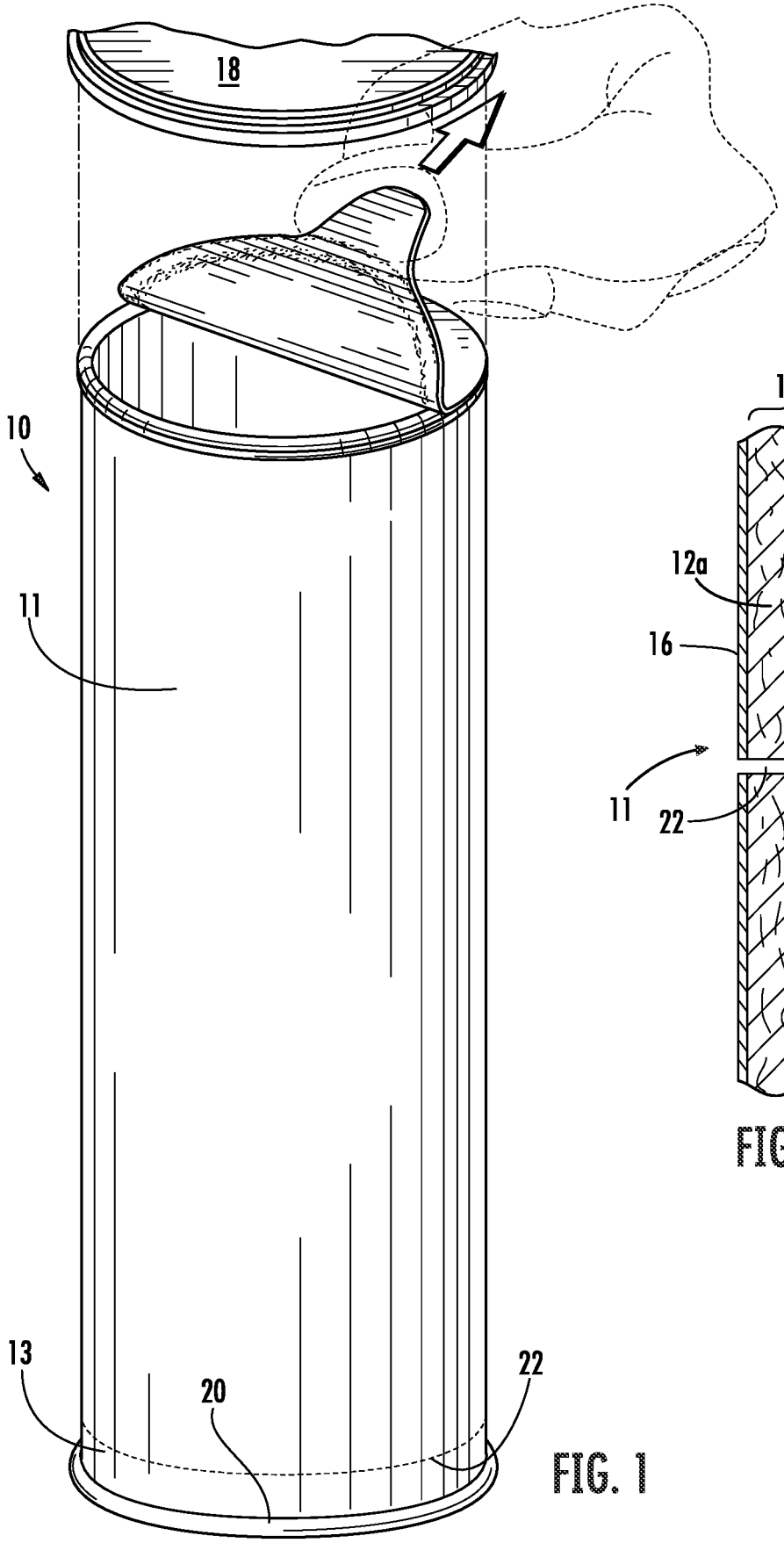
FIG. 1 is a perspective view of an embodiment of a container of the present invention.

FIG. 10A-10D are examples of certain scoring patterns that can be utilized between the container sidewall and the liner ply in certain embodiments of the invention.

Repeated use of reference characters in the present specification and drawings is intended to represent the same or analogous features or elements of the invention.

DETAILED DESCRIPTION OF PREFERRED EMBODIMENTS

Reference will now be made in detail to presently preferred embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

In an embodiment, the invention comprises a composite container for products wherein the container sidewall comprises at least one region of weakened strength. The container may comprise, in certain embodiments, a multi-ply composite tube with at least one sidewall that includes at least one paperboard body ply, optionally, a liner ply adhered to the inner surface of the tubular body ply, and, optionally, a label ply adhered to the outer surface of the body ply.

In an embodiment, the container comprises at least one circumferential score line disposed in the container sidewall that creates a region of weakened strength. The circumferential score line may extend partially around, substantially around, or fully around the circumference of the sidewall, near the end of the container which comprises the permanently adhered end closure. The at least one circumferential score line advantageously allows the end portion (which includes the permanently adhered end closure) nearest the region of weakened strength to be removed from the remainder of the container after use. The end portion may then be recycled or discarded and the container body may be separately recycled.

The method of forming the inventive container with at least one region of weakened strength includes the steps of, in an embodiment, advancing a continuous body ply formed of paperboard material towards a shaping mandrel. The body ply is then wrapped around the shaping mandrel to create a tube. In an embodiment, the body ply is spirally wound around the mandrel or passed through a series of forming elements so as to be wrapped in a convolute shape around the mandrel.

The tube is then scored to create a region of weakened strength in the composite tube. The step of scoring the tube may comprise perforating the tube or grooving the tube (i.e. a cut line that extends partially, but not fully through the tube structure). In some embodiments, the scoring step may be performed in line with the tube formation steps, following formation of the tube. In another embodiment, the scoring step may be performed on a stand-alone machine designed for such scoring process. In yet another embodiment, the scoring step may be performed using seaming equipment, during the seaming step which adheres the end closure to the tube.

In an embodiment, the container includes a liner ply which is not scored, perforated or grooved in the noted process. In an embodiment, the scoring step includes scoring the tube with a laser. In another embodiment, the scoring step includes scoring the tube with a knife.

Referring now to the drawings, FIG. 1 illustrates a tubular composite container 10 with at least one region of weakened strength 24 (FIG. 3) disposed in the container sidewall 11. The region of weakened strength 24 may comprise a region which extends outwardly from either side of a circumferential cut line 22, toward either end of the container body. The size of the region of weakened strength 24 may vary based upon the type of cut line 22 (i.e. perforated, continuous, grooved), the depth of the cut line 22 through the sidewall 11, the strength of the container sidewall 11, and may other factors. The region of weakened strength 24 may comprise a region having more flexibility than the remainder of the container sidewall 11, such that it can be physically manipulated, as will be described herein, to allow removal of an end of the container 10. For example, the region of weakened strength 24 may be predisposed to bend inwardly, toward the interior of the container, upon the application of external forces, until the portion of the sidewall 11 which is adjacent the cut line 22 is severed. This will be explained more fully herein.

Although illustrated as having a circular cross-section, the container 10 of the invention may have any cross-sectional shape known in the art. In an embodiment, for example, the container could have an ovular, square, rectangular, oblong, or egg-shaped cross-section. As merely an example, the container may have a generally rectangular cross-section with rounded corners.

In an embodiment, the container 10 comprises at least one sidewall which extends between two open ends of the container. In some embodiments, such as wherein the container has a square cross section, the container 10 may comprise multiple sidewalls, such as four sidewalls. Any number of sidewalls known in the art is contemplated herein.

Figure 2:
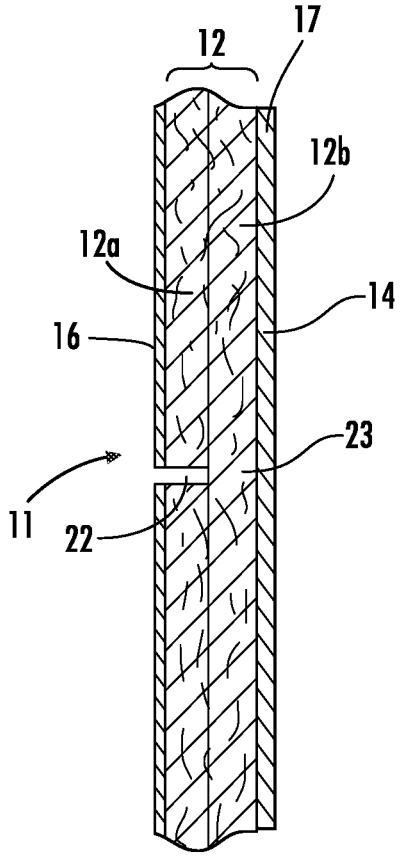
FIG. 2 is cross-sectional view of an embodiment of a container of the present invention.

The embodiment of the container 10 illustrated in FIGS. 1-2 includes a single container sidewall 11 which comprises a tubular body ply 12 formed of paperboard material, an optional liner ply 14 which is at least partially adhered to the inner surface of the tubular body ply 12, and an optional label ply 16 which is adhered to the outer surface of the tubular body ply 12. In an embodiment, the container 10 does not include a label ply 16 and, instead, any printing or labeling is disposed on the exterior surface of the body ply 12.

In an embodiment, the composite container 10 also includes an overcap 18, a flexible removable membrane 29 and a plastic or metal bottom end closure 20. In an embodiment the bottom end closure 20 is permanently affixed to the container sidewall 11, such as through a double seam, pinch seam, or crimp seam. Various end closures may be used, depending upon the type of product which is to be packaged. Likewise, though the end closure 20 is described as plastic or metal, any material known in the art may be utilized for the end closure. In some embodiments, the material used for the end closure 20 is different than the material used for the container sidewall 11. In an embodiment, the material used for the end closure 20 cannot be recycled with the material used for the container sidewall 11—that is, they must be separately recycled.

The container 10 of the invention also includes at least one score line 22 extending at least partially circumferentially about the composite container 10. The score line(s) 22 may extend only partially about the circumference of the composite container 10, may extend substantially about the circumference of the composite container 10, or may extend completely about the circumference of the composite container 10. The score line 22 may be a continuous score line, a perforated score line, a series of aligned but discontinuous grooves, or any other type of score line known in the art. The score line 22 may extend partially, substantially, or fully through the body ply 12. That is, the score line 22 may extend through part of the thickness, but not the entire thickness of the body ply 12. Examples of score lines 22 that may be utilized are provided in FIGS. 10A-10D.

In an embodiment, the paperboard body ply 12 is made of a relatively thick and/or stiff paperboard. In an embodiment, the paperboard body ply may have a thickness of between about 0.012 inches (12 points) and 0.036 inches (36 points). In a particular embodiment, the paperboard body ply may have a thickness of about 0.024 inches (24 points). Any paperboard known in the art may be used in this invention. In embodiments wherein the body ply 12 comprises a multi-ply structure, the total thickness of the body plies may have a thickness of about 0.024 inches (24 points). For example, the body ply 12 may comprise a two-ply structure, with each of the body plies having a thickness of about 0.012 inches (12 points).

In an embodiment illustrated in FIG. 2, the score lines 22 may be cut through the optional label ply 16 and through part but not all of the body ply 12. In this embodiment, the body ply 12 comprises a two-ply structure. The score line 22 extends through the outer body ply 12*a* but does not extend into (or in another embodiment, does not extend substantially into) the inner body ply 12*b*. In this embodiment, the outer body ply 12*a* and the inner body ply 12*b* may have the same thickness, but this need not be the case. The outer body ply 12*a* may be thicker or thinner than the inner body ply 12*b*. The body ply structure described provides the container 10 with structural integrity to maintain its shape and not collapse, but allows the bottom end 13 of the container to be removable via the score line 22.

Note that while the bottom end 13 of the container is described herein as being removable, the top end or the bottom and top ends may both be removable using the invention set forth herein. That is, a score line may circumvent the top end and/or the bottom end of the container, as described herein, to allow removability of that end.

In some embodiments, the score line 22 does not extend into the optional liner ply 14 of the composite container 10 to ensure that the product contained within is not exposed to the environment.

Figure 3:
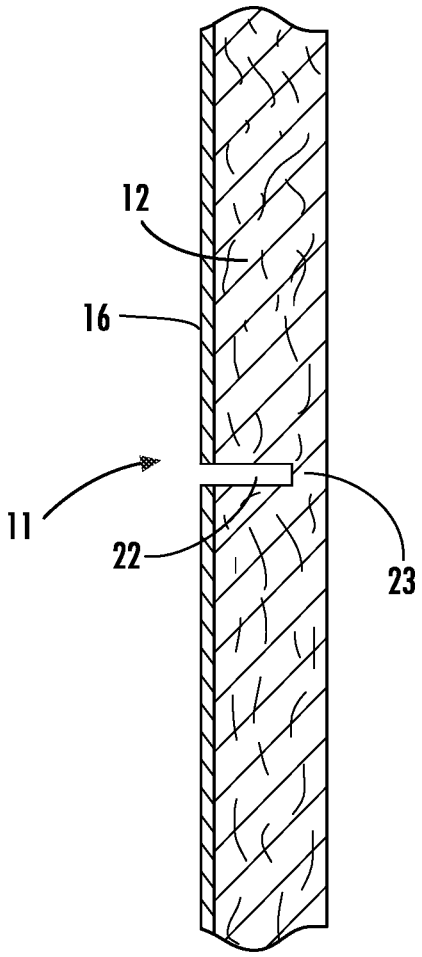
FIG. 3 is cross-sectional view of an embodiment of a container of the present invention.

In the embodiment illustrated in FIG. 3, the container 10 does not have a liner ply and the score lines 22 are cut through the optional label ply 16 and partially, but not fully, through the body ply 12. In this embodiment, any necessary barrier materials may be incorporated into the body ply 12. It should be understood that the embodiment shown in FIG. 3 could optionally have a liner ply 14 as well, however. In this embodiment, the score lines 22 may extend far enough into the body ply 12 such that the consumer can remove the bottom portion 13 of the sidewall 11 from the remainder of the sidewall 11 with minimal effort. In some embodiments, the score lines 22 may extend approximately halfway into the body ply 12.

In an embodiment, the depth of the score lines 22 may be between about 0.005 and 0.030 inches. In another embodiment, the depth of the score lines 22 may be between about 0.008 and 0.022 inches. In an embodiment, the depth of the uncut portion of the sidewall (i.e. the portion between the score line 22 and the interior of the container) may be between 0.001 and 0.005 inches. In another embodiment, the depth of the uncut portion of the sidewall may be between 0.002 and 0.003 inches.

The location of the score lines 22 should be near the end closure 20, but may vary based upon the container construction. In an embodiment, the distance between the score lines 22 and end of the plastic or metal end closure 20 may be between about 0.100 inches and about 0.400 inches. In another embodiment, the distance between the score lines 22 and end of the plastic or metal end closure 20 may be between about 0.180 inches and about 0.250 inches. This distance allows recyclability of a metal bottom end separately from a paper-based container. That is, the remaining amount of paper-based container on the metal bottom end does not prevent recyclability in a single-stream recycling process.

In some embodiments, the consumer may remove the bottom portion 13 of the container 10 from the remainder of the sidewall 11 after use. In an embodiment, the consumer may be directed to insert or push one or both thumbs into the location of the score lines 22 in order to separate or tear through at least one portion of the body ply 12 which has not been scored (identified as element 23) at the location of the score line 22 (i.e. the inner body ply 12*b* or similar portions of the body ply). For purposes of removing the bottom end, the consumer may be directed to dispose the container 10 on its side (i.e. horizontally), top-side-up (i.e. vertically), upside down, with the bottom portion 13 pointing upwardly, in an angled manner, on a hard surface, or in any other known configuration, in an embodiment. In an embodiment, the consumer may have to overcome a tear or opening force at the score lines 22 to break through a portion of the body ply 12 which has not been scored 23. Once a portion of the body ply 12 which has not been scored 23 is torn through, the consumer may remove the bottom portion 13 of the container 10 by pulling the bottom portion 13 away from the remainder of the sidewall 11 and/or pushing along the edge of score line 22 to tear through the remainder of the body ply 12 at the location of the score line 22.

In an embodiment, the consumer may tear through any liner ply 14 which is present as the score line 22 is torn through. In another embodiment, the liner ply 14 remains intact after removal of the bottom portion 13 of the container.

Figure 4:
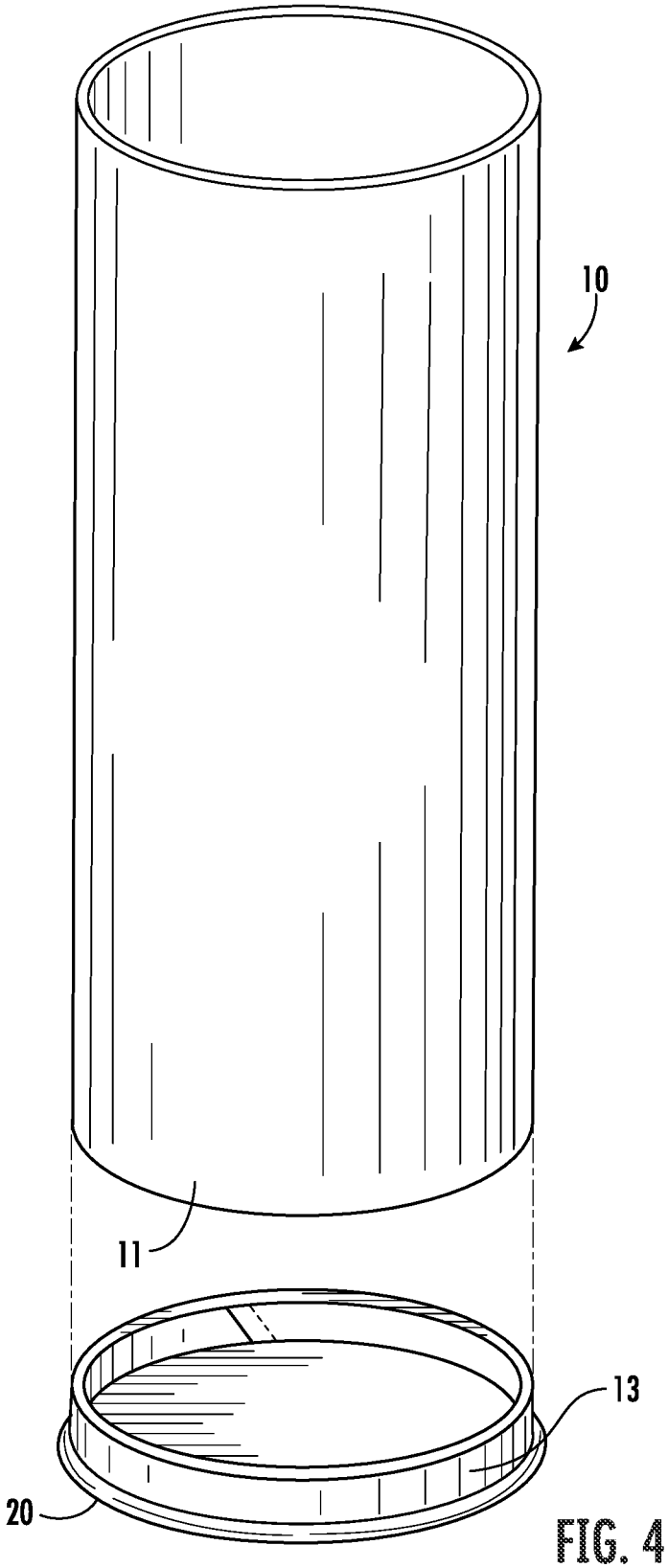
FIG. 4 is a perspective view of an embodiment of a container of the present invention after removal of the bottom portion of the container.
Figure 7:
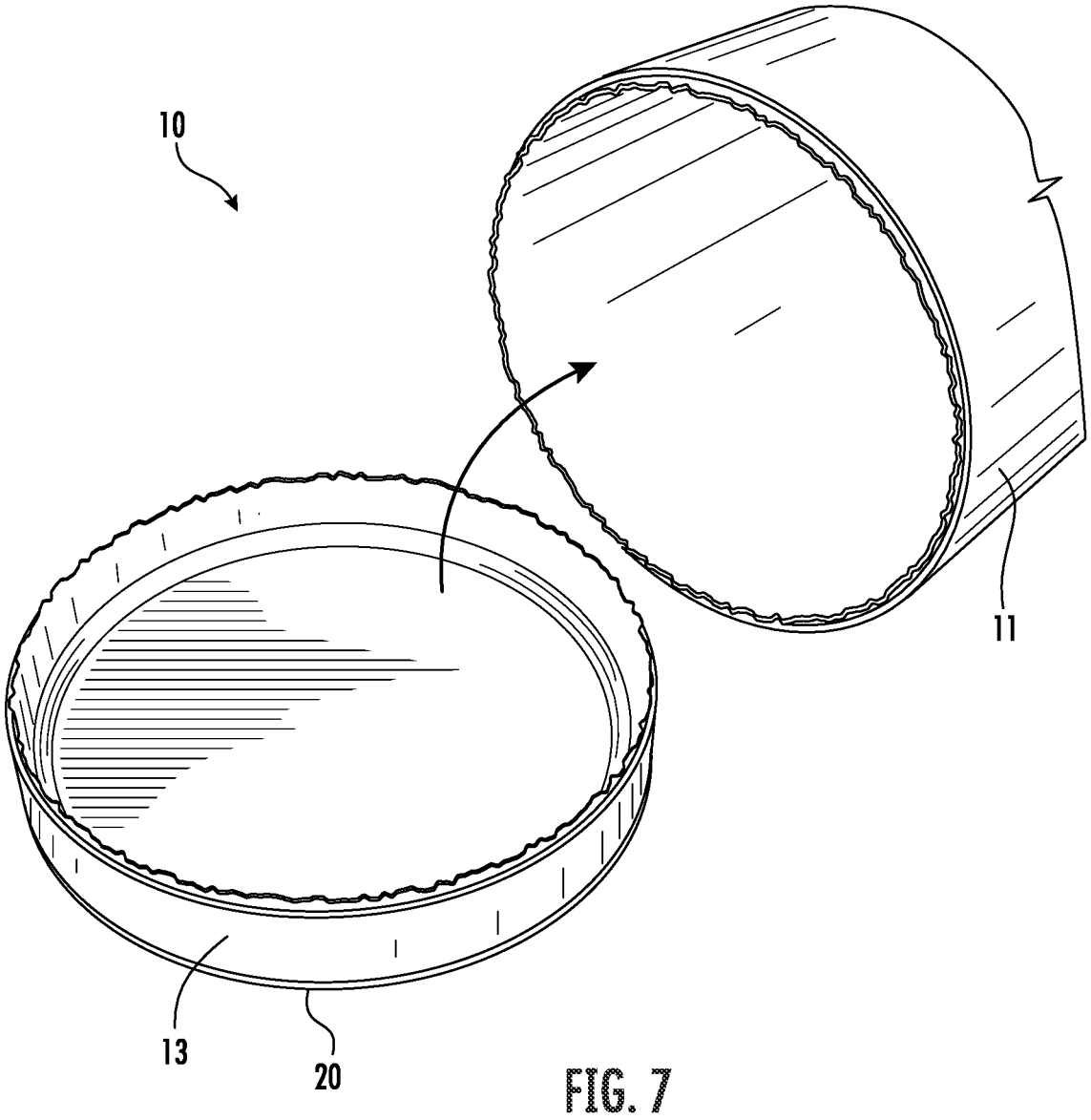
FIG. 7 is an image illustrating an embodiment of the invention after removal of the bottom portion of the container.

FIGS. 4 and 7 illustrate an embodiment of the container after separation of the bottom portion 13 from the remainder of the sidewall 11. As can be seen, the metal or plastic end closure 20 remains with the bottom portion 13 after separation.

In some embodiments, a liner ply 14 is present. In certain embodiments, the liner ply 14 may include one or more layers. For example, the liner ply 14 may comprise several layers including a barrier layer to prevent the passage of moisture and gasses into and out of the container, a foil barrier layer, and/or one or more polymer layers. Barrier materials may include, in an embodiment, polyester, nylon, EVOH (ethylene vinyl alcohol polymer and copolymer), polyvinylidene chloride, polyethylene, polypropylene, and silicon dioxide coated polymers and the like, as will be apparent to the skilled artisan. In an embodiment, the liner ply 14 may comprise polyethylene, polypropylene, polyvinylchloride, or polyethylene terephthalate ("PET"). Any liner ply known in the art may be used herein. In one embodiment, the liner ply may be substantially or partially transparent or translucent. In an embodiment, the liner ply has a thickness of less than about three mils. In another embodiment, the liner ply has a thickness of between about 0.5 mils and 20 mils. In an embodiment, the thickness of the liner ply 14 is such that it can be torn through relatively easily when the bottom portion 13 is separated from the remainder of the container 10. In another embodiment, the liner ply 14 remains intact when the bottom portion 13 of the container is removed.

In an embodiment, the liner ply 14 is at least partially adhered to the interior surface of the body ply 12. In an embodiment, the liner ply 14 is not adhered to the bottom end closure 20. In an embodiment, an adhesive layer 19 is disposed between the liner ply 14 and the body ply 12. The adhesive layer 19 may be a releasable adhesive. The adhesive layer 19 may be a cohesive in an embodiment. The adhesive layer 19, in an embodiment, is flood coated over the surface of the liner ply 14 and/or the body ply 12. In this embodiment, the adhesive may have 100% coverage or nearly 100% coverage between the liner ply 14 and the body ply 12. In this embodiment, the adhesive layer 19 may comprise a weak adhesive, such as a cornstarch-based or dextrin-based adhesive, a pressure sensitive adhesive, or any other adhesive that has a limited or releasable adhesion.

In this embodiment, the weak adhesive may allow the liner ply 14 to separate from the body ply 12 upon a pulling pressure exerted by the consumer. For example, when the bottom portion 13 of the container is removed, the liner ply 14 may separate from the bottom portion 13 of the container and remain adhered to the remainder of the container sidewall 11.

Additionally or alternatively, after the bottom portion 13 of the container is removed, the consumer may grasp the a portion (i.e. the separated portion or torn portion) of the liner ply 14 near the edge of the score lines 22 and may pull the liner ply 14 away from the inner surface of sidewall 11. Progressing through the interior of sidewall 11, the consumer may completely or nearly completely separate the liner ply 14 from the sidewall 11 and pull it out of the container body. The sidewall 11 may then be recycled separately from the bottom portion 13 and/or the liner ply 14.

Figure 9A:
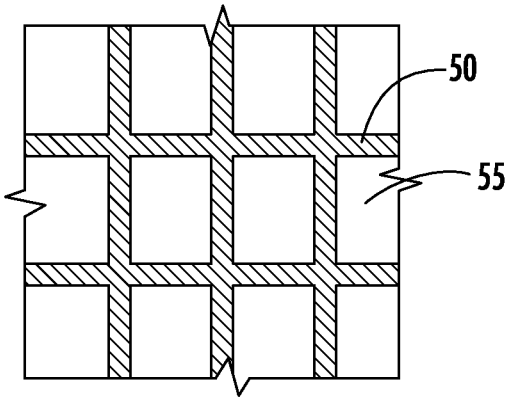
FIGS. 9A-9D are examples of certain adhesive patterns that can be utilized between the container sidewall and the liner ply in certain embodiments of the invention.
Figure 9B:
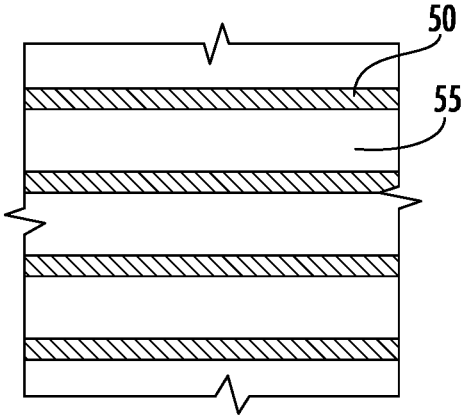
Figure 9C:
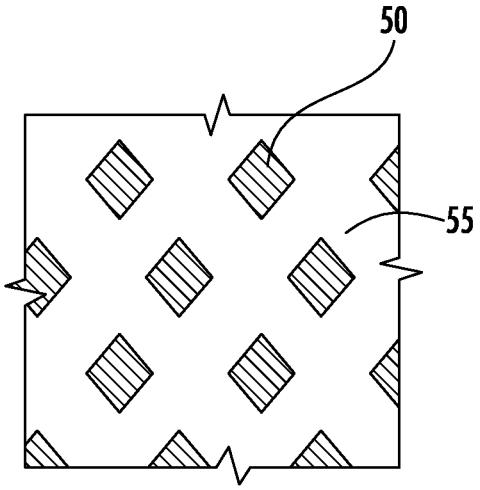
Figure 9D:
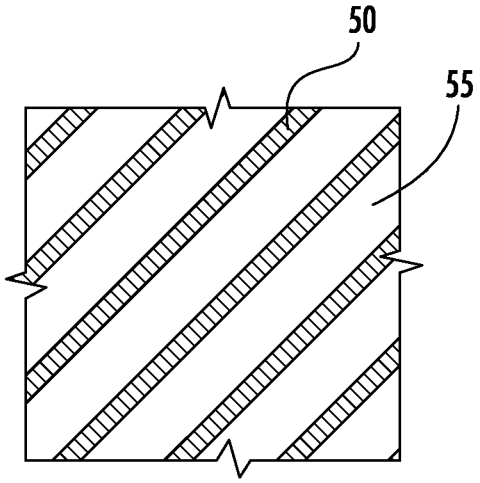
Figure 10A:
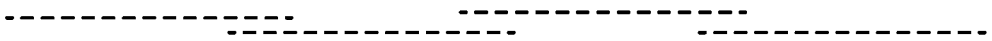
Figure 10B:
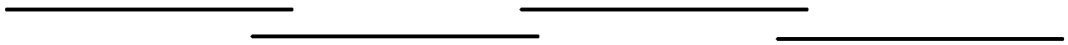
Figure 10C:
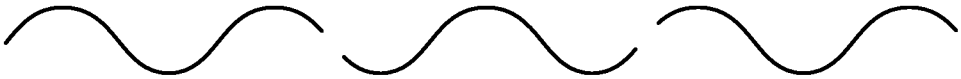
Figure 10D:
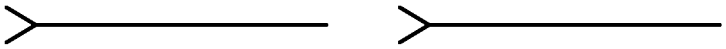

In another example, the adhesive layer 19 may be pattern applied to either the liner ply 14 or the body ply 12 interior surface prior to application of the liner ply 14 to the body ply 12. In this embodiment, the pattern of the adhesive 50 which comprises the adhesive layer 19, between the liner ply 17 and the body ply 13 may comprise one or more adhesive-free regions 55 (shown in FIG. 9). In an embodiment, the pattern of the adhesive layer 19 may be repetitive, such as a plaid, horizontal, vertical or diagonal stripes, a repeating diamond, a criss-cross, or a cross-hatched pattern. Some examples are set forth in FIG. 9, but the invention should not be limited to these patterns. The pattern may follow the spiral pattern of the container, in an embodiment. For example, the diagonal pattern shown in FIG. 9D may follow the spiral of the container. Any pattern known in the art may be utilized. In other embodiments, the adhesive pattern between the liner ply 14 and body ply 12 is asymmetrical.

Figure 8A:
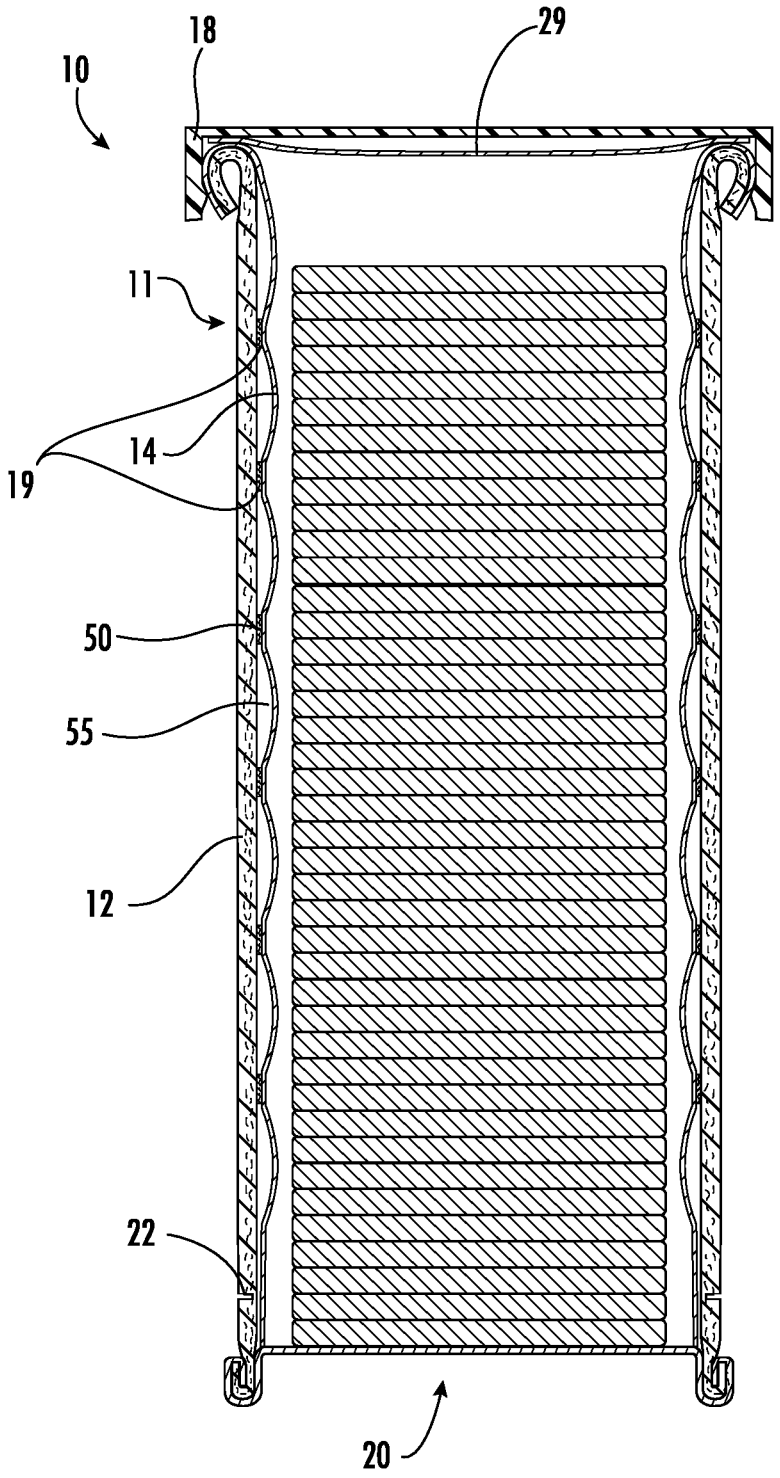
FIGS. 8A-8B are cross-sectional views of a container structure in an embodiment of the invention.
Figure 8B:
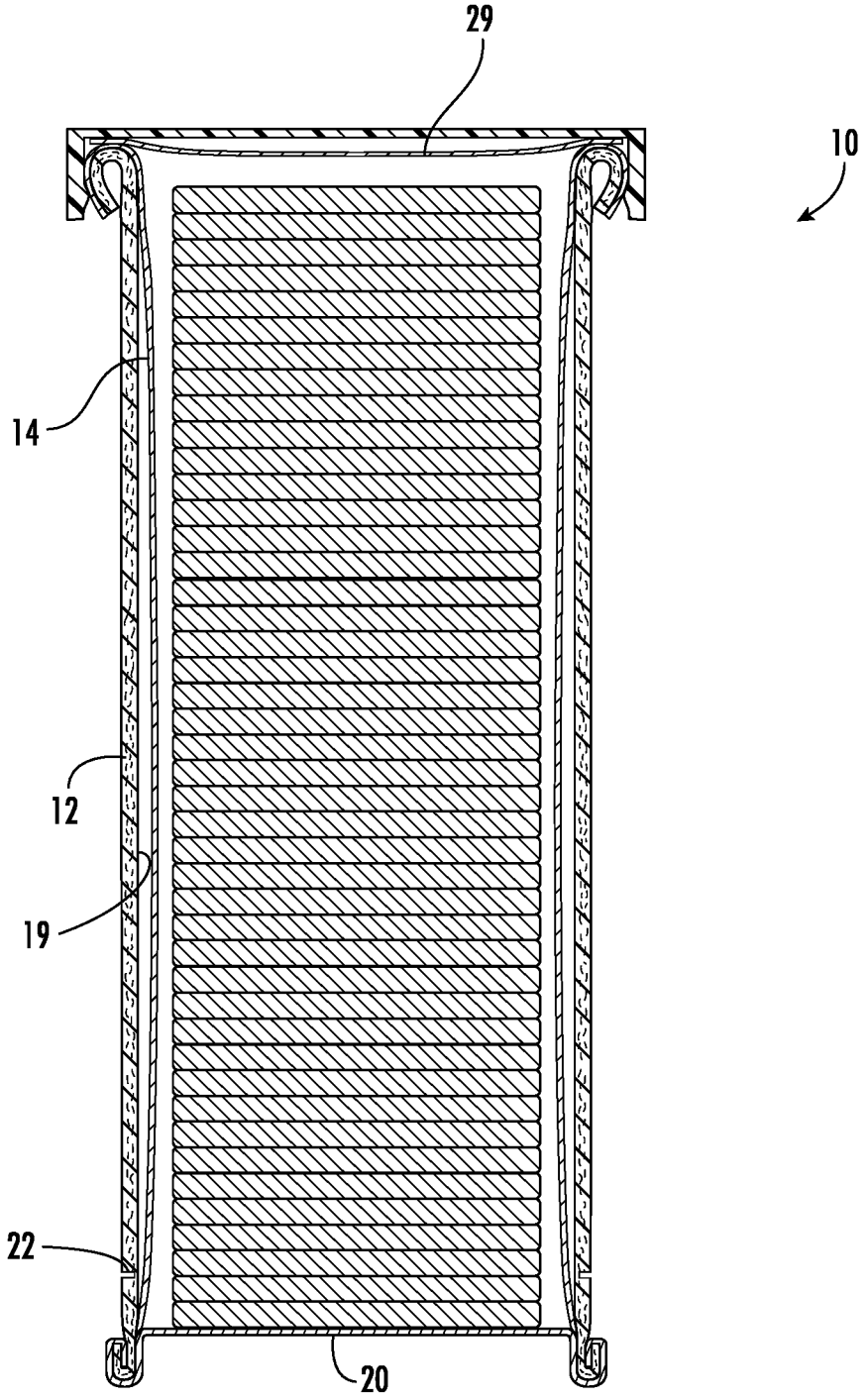

In these embodiments, the adhesive utilized may comprise a stronger adhesive than would be used in the 100% coverage embodiment. An example of a stronger adhesive which could be used in this embodiment is a polyvinyl acetate (PVA)-based adhesive, such as PVAc white glue, or any other adhesive known in the art. Alternatively, however, a weak adhesive, such as a dextrin adhesive, a pressure sensitive adhesive, or any other adhesive that has a limited or releasable adhesion could also be utilized in this pattern-applied embodiment. In this embodiment, the liner ply 14 may not be adhered to the body ply 12 in the adhesive-free regions 55. For example, FIG. 8 shows a cross-sectional view of the tubular container 10 wherein the liner ply 14 is sealed with a pattern adhesive layer 19 and is unadhered to the body ply 12 in the adhesive-free regions 55.

In an embodiment, a food product is stacked or stored within the container 10. In this embodiment, the food product does not directly contact the inner surface of the container sidewall 11 due to the interference of the liner ply 14, when present. Byproducts from the food product (i.e. oil, grease) are thus prevented from contact with or migration into the container body ply 12. In this way, the body ply 12 can be easily recycled if the liner ply 14 is removed from its interior. Likewise, liner ply 14 can also be recycled. In an particular embodiment, use of the liner ply 14 may avoid the need for a barrier film or barrier layer to be applied to the interior surface of the container body or incorporated into the body ply 12, thereby reducing costs, manufacturing time, and improving the recyclability of the container.

A unique advantage to the invention is that even if a consumer fails to remove the bottom end 13 of the container (which includes the metal end), the score lines 22 create a weakened area 24 such that if the container is recycled in a paper-based process, the container will be crushed as part of the recycling process and the bottom end 13 will separate itself from the remainder of the container. The metal end (and accompanying portion of the bottom end 13) can then be removed from the recycling stream via a magnet. Thus, recyclability is improved for the container.

While the weakened area 24 is described herein with reference to the score line 22, it should be understood that the weakened area 24 may be formed via other methods and constructions. For example, the weakened area 24 may comprise a compressed area of the sidewall, a thinner area of the sidewall, an area of the sidewall having a different composition or layering, a different method of grooving the sidewall, etc.

Figure 5:
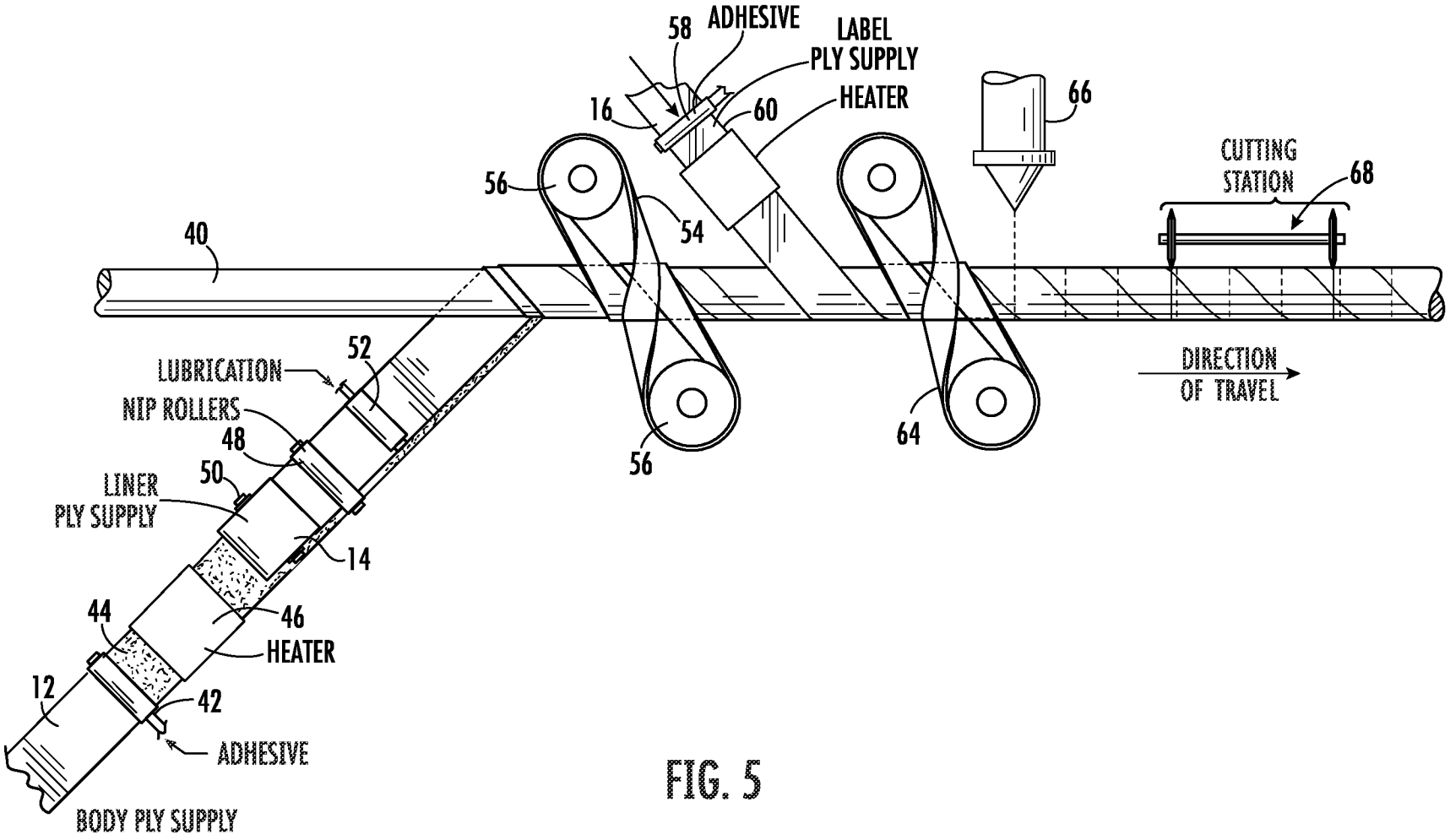
FIG. 5 is an illustration of a method in an embodiment of the invention.
Figure 6:
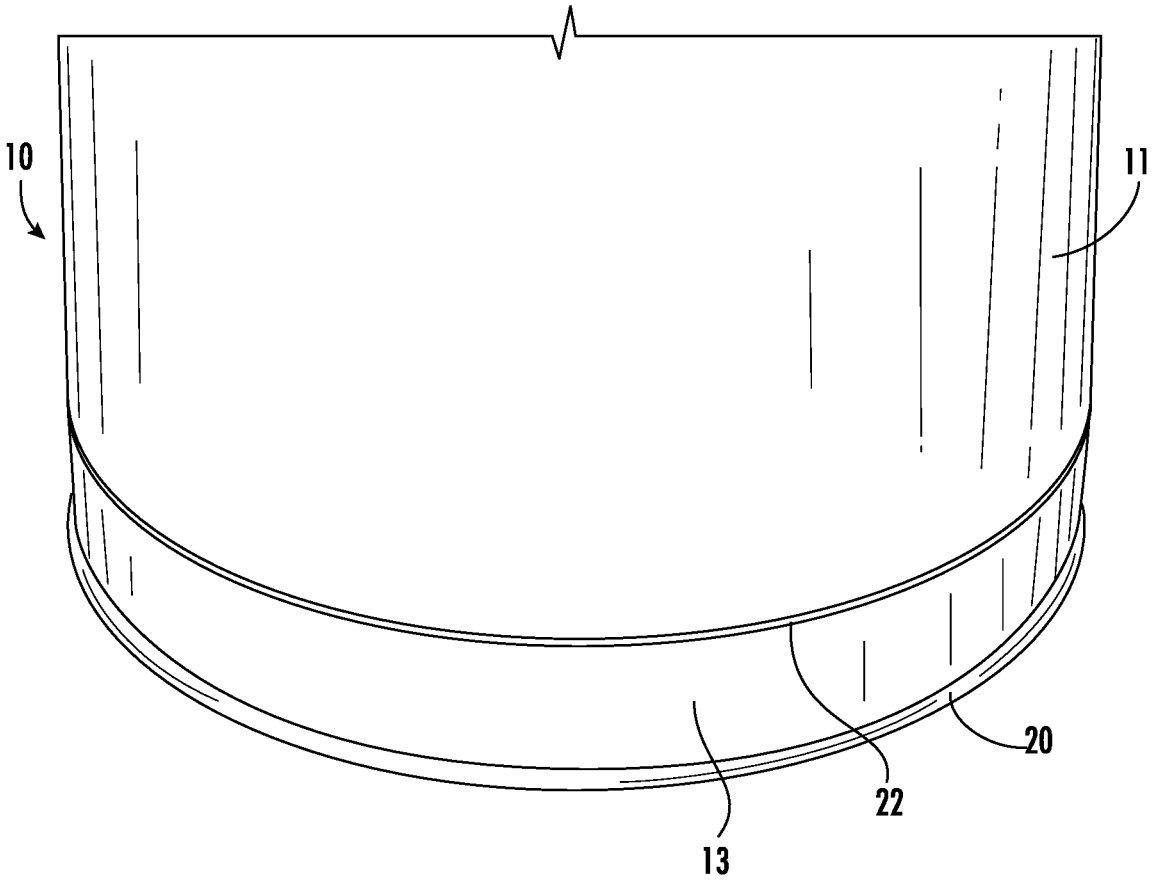
FIG. 6 is an image illustrating an embodiment of the invention.

FIG. 5 illustrates a method for making an exemplary container with a region of weakened strength 24 according to an embodiment of the present invention. A continuous strip of paperboard body ply material 12 (single ply or multi-ply) is first advanced toward a shaping mandrel 40. As the paperboard body ply material 12 is advanced toward the shaping mandrel 40, the body ply 12 may optionally be advanced through an adhesive applicator 42 which applies an adhesive 44 to the inner surface of the body ply 12. The adhesive may be flood coated (100% coverage) or may be pattern applied in any pattern known in the art.

The body ply 12 and the adhesive 44 applied thereto may then be passed underneath a heater 46 to render the adhesive 44 substantially tacky. A preferred type of heat source is an infrared heater although various other heat sources, e.g., forced air heating or the like can also be used.

In this optional step, after passing underneath the heater 46, the body ply 12 is then advanced into a pair of opposed nip rollers 48. A continuous strip of liner ply material 14 is fed from a reel 50 and is also advanced into the nip 48 adjacent the adhesived inner surface of the body ply 12. The adhesive 44 is substantially tacky and thus instantaneously bonds to the liner ply 14 without slippage as they are nipped together. It will be understood to those skilled in the art that various liner constructions with various barrier materials or properties could be employed depending upon the item being packing in the composite container 10. In addition, the body ply 12 and liner ply 14 could be brought together from opposite sides of the mandrel 40 and adhered together while on the mandrel. The liner ply 14 may be wider or narrower than the body ply 12 depending on the amount of liner overlap that is desired.

After advancing the body ply 12 and the liner ply 14 through the pair of nip rollers 48, the liner ply 14 may then be coated with lubricant from a roller 52, which allows the liner ply 14 to slide smoothly during the winding operation.

The body ply 12/liner ply 14 laminate is next wrapped around the shaping mandrel 40. The laminate is first wrapped under the mandrel 40 and then back over the top in a helical fashion with the liner ply 14 wound against the surface of the mandrel 40. As the body ply 12/liner ply 14 laminate advances back under the mandrel 40 after one complete revolution, its trailing edge is brought into contact with the leading edge of the ensuing portion of the body ply 12/liner ply 14 laminate, which is first coming into contact with the mandrel 40. The edges become abutted together to form a spirally wound tube that advances along the mandrel 40.

The tube is then advanced down the mandrel 40 by a winding belt 54 that extends around a pair of opposed pulleys 56. The winding belt 54 not only rotates and advances the tube, but also applies pressure to the overlapping edges of the body ply 12 and liner ply 14 to ensure a secure bond between the respective ply edges.

Downstream of the winding belt 54, a continuous label ply 16 may optionally be advanced toward the shaping mandrel 40 through an adhesive applicator 58 which applies an adhesive 60 to the inner surface of the label ply 16. The label ply 16 and the adhesive 60 applied thereto are then passed underneath a heater 62 to render the adhesive substantially tacky.

After passing underneath the heater 46, the label ply 16 may then be wrapped around the shaping mandrel 40 onto the advancing body ply 12/liner ply 14 laminate. The wrapped plies are then advanced down the mandrel 40 by a winding belt 64. The winding belt 64 rotates and advances the wrapped plies and applies pressure to the overlapping edges of the plies to ensure a secure bond between the respective ply edges.

After the label ply 16 is optionally adhered to the advancing body ply 12/liner ply 14 laminate on the mandrel 40 to create a continuous tube 10, the continuous tube 10 is scored (through the label ply 16 if present) and at least part of the body ply 12 to create a region of weakened strength 24 in the composite tube 10. In the embodiment shown in FIG. 5, the scoring is performed using a laser 66. The scoring step may, however, also be achieved using a knife or cutting station. After the continuous tube 10 is scored, the composite tube is cut into discrete lengths at a cutting station 68, and then removed from the mandrel 40. Although a spiral wound container is described and shown in the figures, it should be understood that any winding method known in the art could be utilized to form the container. Although the embodiment shown in FIG. 5 illustrates the scoring step occurring during the tube formation, the scoring step may occur separately. For example, the scoring step may occur at a standalone machine.

In an embodiment a metal or plastic end 20 may then be applied to at least one end of the container body. In an embodiment, the metal end 20 and the container sidewall 11 are joined together by a double seam, crimp seam, pinch seam, or any other seam known in the art. A sealing compound (i.e. a water or solvent dispersion solution of rubber) may optionally be used within the seam.

If utilized, the double seaming operation may include a first seaming operation and a second seaming operation. In the first seaming operation, a chuck panel of the metal end may be seated against a seaming roll of a closing machine, wherein the metal end is urged against a seaming chuck. During the first seaming operation, a flange of the container body 11 may be introduced to the metal end 12. An optional compound may also be introduced. Thereafter, the rotating first operation seaming roll may be cammed toward the rotating seaming chuck to initially engage the curl of a metal end 12.

The second seaming operation may be designed to flatten out the double seam of the composite container. The seaming chuck may be cam advanced towards the seaming roll. The parts may continue to rotate about the container sidewall 11 to complete the double seaming operation. Simultaneously or in an in-line process, the score line 22 may be formed in the sidewall 11 using a suitable laser or knife rotating about the container sidewall 11.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged in whole or in part. Furthermore, those of ordinary skill in the art will appreciate that the foregoing description is by way of example only, and is not intended to limit the invention so further described in such appended claims. Therefore, the spirit and scope of the appended claims should not be limited to the description of the versions contained therein.

What is claimed is:

1. A container comprising:

a base;

at least one paper-based sidewall extending upwardly from the base, wherein the at least one sidewall comprises a score line near the base that is at least partially circumferential and is configured to be torn through to remove the base from the sidewall, wherein the score line delineates a bottom portion of the container comprising the base and a portion of the at least one paper-based sidewall, wherein the bottom portion of the container is configured to be removed from the remainder of the container; and a liner ply releasably adhered to an interior surface of the sidewall and unadhered to the base, wherein the liner ply is configured to separate from the interior surface of the paper-based sidewall after removal of the bottom portion.

2. The container of claim 1 wherein the container sidewall comprises a composite material.

3. The container of claim 1 wherein the container is rigid.

4. The container of claim 1 wherein the container comprises spiral-wound paperboard.

5. The container of claim 1 wherein the liner ply comprises a polymeric material.

6. The container of claim 1 wherein the liner ply comprises barrier properties.

7. The container of claim 1 wherein a releasable adhesive is disposed between the liner ply and the paper-based sidewall.

8. The container of claim 7 wherein the adhesive comprises a polyvinyl acetate-based adhesive or a dextrin-based adhesive.

9. The container of claim 1 wherein the base comprises metal.

10. The container of claim 1 wherein the score line comprises a fully circumferential perforation.

11. The container of claim 1 wherein the score line comprises a continuous cut line, is fully circumferential, and does not penetrate the entire thickness of the sidewall.

12. The container of claim 11 wherein the score line extends substantially through the thickness of the sidewall.

13. The container of claim 1 wherein after the bottom portion of the container is removed, a portion of the liner ply may be grasped and pulled away from the sidewall.

14. The container of claim 13 wherein the liner ply is configured to be completely or nearly completely separated from the sidewall and pulled out of the container body.

15. A method of recycling a container, the method comprising:

providing a container comprising:

a base;

at least one paper-based sidewall extending upwardly from the base, wherein the at least one sidewall comprises a score line near the base that is at least partially circumferential and is configured to be torn through to remove the base from the sidewall, wherein the score line delineates a bottom portion of the container comprising the base and a portion of the at least one paper-based sidewall, wherein the bottom portion of the container is configured to be removed from the remainder of the container; and a liner ply releasably adhered to an interior surface of the sidewall and unadhered to the base, wherein the liner ply is configured to separate from the interior surface of the paper-based sidewall after removal of the bottom portion;

crushing the at least one paper-based sidewall adjacent the at least one score line; and removing the base and a portion of the at least one paper-based sidewall from a remainder of the at least one paper-based sidewall, wherein the liner ply remains with the remainder of the at least one paper-based sidewall.

16. The method of claim 15 further comprising, after the bottom portion of the container is removed, grasping and pulling a portion of the liner ply away from the sidewall.

17. The method of claim 16 further comprising completely or nearly completely separating the liner ply from the sidewall and pulling the liner ply out of the container body.

* * * * *